US010994388B2

(12) United States Patent
Rovinelli

(10) Patent No.: US 10,994,388 B2
(45) Date of Patent: May 4, 2021

(54) MACHINE TOOL FOR MULTIPLE WORKING OF SURFACES OF BODIES

(71) Applicant: R.BIEMME-TECH S.R.L., Fano (IT)

(72) Inventor: Massimiliano Rovinelli, Fano (IT)

(73) Assignee: R.BIEMME TECH S.R.L., Fano (IT)

( * ) Notice: Subject to any disclaimer, the term of this patent is extended or adjusted under 35 U.S.C. 154(b) by 489 days.

(21) Appl. No.: 15/756,138

(22) PCT Filed: Sep. 1, 2016

(86) PCT No.: PCT/IT2016/000203

§ 371 (c)(1),
(2) Date: Feb. 28, 2018

(87) PCT Pub. No.: WO2017/037750

PCT Pub. Date: Mar. 9, 2017

(65) Prior Publication Data

US 2018/0281145 A1 Oct. 4, 2018

(30) Foreign Application Priority Data

Sep. 4, 2015 (IT) ..... 102015000048610

(51) Int. Cl.

| | |
|---|---|
| ***B24B 19/02*** | (2006.01) |
| ***B24B 5/04*** | (2006.01) |
| ***B24B 5/313*** | (2006.01) |
| ***B24B 5/38*** | (2006.01) |
| ***B24B 9/00*** | (2006.01) |

(52) U.S. Cl.

CPC ..... *B24B 19/02* (2013.01); *B24B 5/04* (2013.01); *B24B 5/313* (2013.01); *B24B 5/38* (2013.01); *B24B 9/002* (2013.01)

(58) Field of Classification Search

CPC ..... B24B 5/04; B24B 5/313; B24B 5/355; B24B 5/38; B24B 9/002; B24B 11/04; B24B 19/02

USPC ..... 451/49, 51, 190, 194, 197

See application file for complete search history.

(56) References Cited

U.S. PATENT DOCUMENTS 3,305,974 A * 2/1967 Wilson ..... B24B 7/14 451/72
4,481,739 A * 11/1984 Suzuki ..... B24B 7/17 125/11.03
4,761,918 A * 8/1988 Hirota ..... B23Q 1/66 451/265

FOREIGN PATENT DOCUMENTS

JP 2008194759 A 8/2008
JP 2011212830 A 10/2011

OTHER PUBLICATIONS

International Search Report and Written Opinion dated Dec. 12, 2016 from counterpart PCT App No. PCT/IT2016/000203.

* cited by examiner

*Primary Examiner* — Eileen P Morgan
(74) *Attorney, Agent, or Firm* — Shuttleworth & Ingersoll, PLC; Timothy Klima

(57) ABSTRACT

A machine tool for multiple working for material removal from surfaces of bodies including a working station in which a plurality of rotary tools are positioned around a feed trajectory of said bodies; and guide means in which the bodies to be worked are made to translate one after another along said feed trajectory with a predetermined orientation position. At least one pair of rotary tools of said working station, intended to interact with the surfaces to be worked, inside slits in said bodies, in combination with each other and with guide means provided with partitions, help to keep said bodies in position during their related transit through said working station.

11 Claims, 2 Drawing Sheets

MACHINE TOOL FOR MULTIPLE WORKING OF SURFACES OF BODIES

This application is the National Phase of International Application PCT/IT2016/000203 filed Sep. 1, 2016 which designated the U.S. and that International Application was published under PCT Article 21(2) in English.

This application claims priority to Italian Application No. 102015000048610 filed Sep. 4, 2015, which application is incorporated by reference herein.

TECHNICAL FIELD

This invention relates to technologies for working materials, preferably metal, using material removal methods and, in particular, relates to a machine for multiple working to remove material from corresponding surfaces of objects which are preferably solids with axial symmetry. In the following description, specific reference is made to grinding working operations, carried out on surfaces of channels of tubular cylindrical pump bodies, preferably produced using sintering methods. However, it shall be understood that this is described purely by way of example and does not limit possible use of the invention. In fact, as will be more apparent below, there are useful and advantageous application for the invention in a very wide range of machining operations relating to general mechanical engineering and/or the production of objects which have the most disparate shapes.

BACKGROUND ART

In the prior art, methods are already known from document U.S. Pat. No. 4,761,918 for grinding pump rotor surfaces involving the working, with stationary support, of a set of rotors that have slits which are channel-shaped, radial, which are drawn near in a pack with the slits correspondingly aligned and in which the slits are run through one after another by a disk grinding wheel translating with a movement one way then the other parallel to the axis of the rotors.

The grinding is carried out, one slot at a time, for all of the slots in the pack that, subsequently and by means of an angular rotation of the entire pack about its own axis, are in an orderly way exposed to the interaction of the grinding wheel until the grinding operations on all of the rotors to be worked have been completed.

Prior art techniques that can be traced back to the above-mentioned operating method have the fundamental disadvantage of requiring long working times and proportionally high working costs.

DISCLOSURE OF THE INVENTION

The technical purpose of this invention is therefore to overcome such disadvantages.

As part of that purpose, the primary aim of this invention is to propose a solution in the form of a machine tool that is able to carry out the working in much shorter times and with a significant reduction in production costs by the multiple working of surfaces of objects to be worked.

In accordance with the invention, that result is achieved by means of a machine tool for multiple removal working of surfaces of metal bodies, whose technical features are described in one or more of the appended claims.

BRIEF DESCRIPTION OF THE DRAWINGS

The advantages of the invention are more apparent in the detailed description which follows, with reference to the accompanying drawings which illustrate an example, non-limiting embodiment of the invention, in which.

DETAILED DESCRIPTION OF PREFERRED EMBODIMENT OF THE INVENTION

Figure 1:
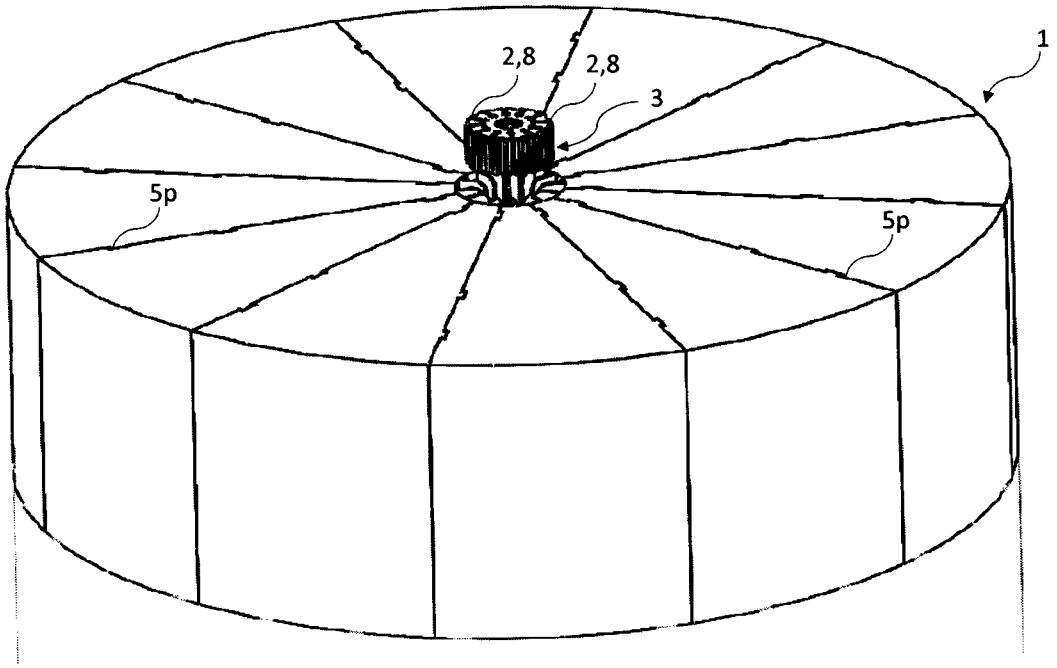
FIG. 1 is a perspective assembly view of a schematic operating core of a machine tool according to this invention.

With reference to the figures of the accompanying drawings, in FIG. 1, the numeral 1 denotes in its entirety a machine tool, in particular a grinding machine, for performing multiple simultaneous removal working on surfaces 2 of bodies 3 that are preferably made of metal and whose shape has axial symmetry. Said bodies 3, in the case in question, are constituted of conventional pump rotors equipped with radial slits 8 that form centrifugal channels, along which a liquid passes, going through the body 3 during pump operation. The rotors are preferably made of metal material using sintering methods.

The machine tool 1 basically comprises (FIG. 2): a working station 4 in which a plurality of rotary tools 5 are positioned and distributed in a circle around a feed trajectory 6 of said bodies 3 during working; and guide means 7, in which the bodies 3 to be worked are made to translate one after another along said feed trajectory 6 with a predetermined orientation position in space.

Figure 2:
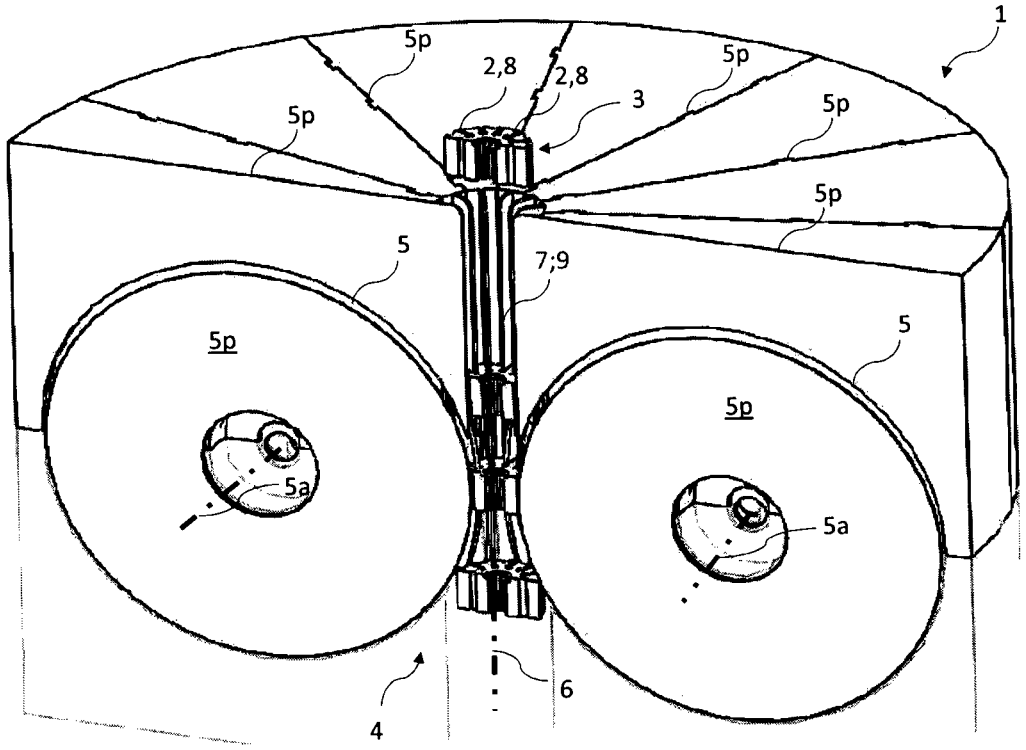
FIG. 2 is a cross-section of the core of FIG. 1.

FIG. 2 highlights in particular that the guide means 7 comprise partitions 9, straight and longitudinal relative to the feed trajectory 6, which engage in the slits 8 of said bodies 3, leaving them free to translate longitudinally relative to said partitions 9.

The partitions 9 are distributed in angular steps around said feed trajectory 6 along at least one arc of an ideal surface that is cylindrical and parallel to said feed trajectory 6.

The rotary tools 5 preferably have a cylindrical shape, preferably being disk-shaped and, during their working motion, they rotate about their own axis 5*a* of rotation, which is slanting and transversal, that is to say, orthogonal, relative to said feed trajectory 6.

The rotary tools 5 lie in their own lying planes 5*p* substantially converging on the feed trajectory 6, that is to say, they lie in planes radial to the feed trajectory 6.

At least one pair of rotary tools 5 of said working station 4 is intended to interact with the surfaces 2 to be ground. That allows the double advantage of being able to work multiple surfaces during the same time period and, simultaneously and if desired, being able to interrupt the continuity of the partitions 9 at the working zone of the rotary tools 5, since the holding of said bodies 3 in position during working station 4 transit is effectively guaranteed by two or more rotary tools 5 working in conjunction with each other, not necessarily arranged symmetrically around the trajectory 6 and operating simultaneously with as many respective slits 8.

In use, the feed trajectory 6 of the bodies 3 through the machine 1 may be travelled multiple times, and if necessary even with reciprocating motion, with corresponding strokes through the working station 4.

For that reason, the machine 1 may comprises rotating means 10 for angularly rotating in steps said bodies 3 around the direction of their translation trajectory 6, between two successive passes through the working station 4.

Figure 3:
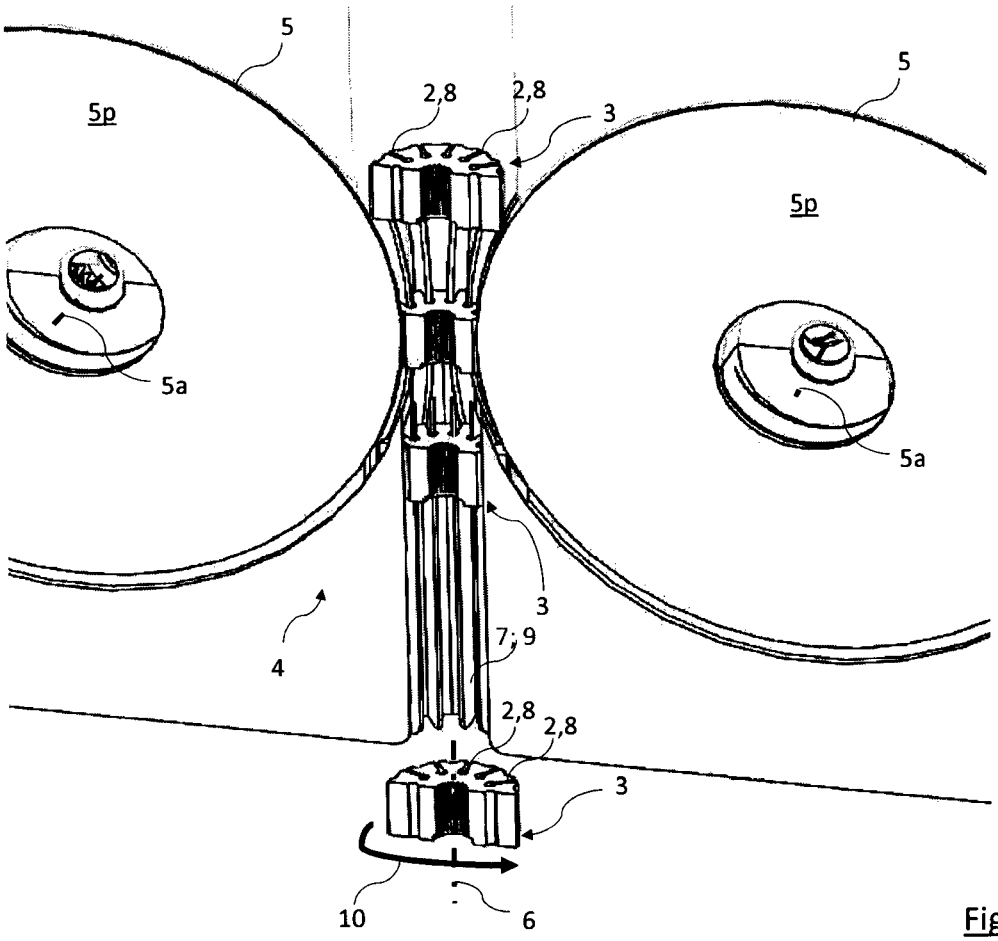
FIG. 3 is a schematic diagram showing the operating method of the machine tool according to the invention.

Obviously, the bodies 3 that have passed through the station 4 may be returned to the station 4 infeed, to pass through it each time with unidirectional and direct feed motion, or with reverse translation, from the bottom upwards in FIG. 3, that is to say, with a to and fro motion through the station 4 driven with the aid of suitable means for lifting the bodies 3 against the action of gravity.

The rotating means 10—symbolically illustrated in FIG. 3 using a directional curve—may have multiple embodiments, for example, angular division systems (geometric, mechanical, optical, electronic, etc.) if necessary operating with suitable motor coordination with the working motion of the rotary tools 5.

Concerning the type of construction of the means for feeding the bodies 3 towards the working station 4, and/or out of the latter, from FIG. 3 it is obvious that these may operate by advantageously and preferably using the effect of gravity on the bodies 3.

In short, the grinding machine 1 described above allows the implementation of a method for the multiple grinding of axially symmetrical bodies 3 comprising the steps of:

feeding a series of bodies 3 along a translation trajectory 6 towards and through a working station 4, which is equipped with a plurality of disk-type rotary tools 5 that are arranged around the feed axis 5*a* and are oriented in such a way that they substantially converge on the feed trajectory 6;

rotating the bodies 3 that have come out of the station 4 by a predetermined angular step;

feeding said series of bodies 3 again with a direct or reverse translation trajectory 6 towards and through the working station 4;

repeating the rotating and feeding steps until the grinding cycle is complete.

The invention described above is susceptible of evident industrial application. It may also be modified and adapted in several ways without thereby departing from the scope of the following claims.

Moreover, all details of the invention may be substituted by technically equivalent elements.

The invention claimed is:

1. A machine for removing material from a workpiece, comprising:

a working station, including;

at least one pair of rotary tools;

a workpiece feed path defined between the at least one pair of rotary tools, the workpiece feed path having a feed trajectory and passing between the at least one pair of rotary tools from an upper end to a lower end of the workpiece feed path;

the at least one pair of rotary tools being positioned around the feed trajectory for removing material from the workpiece as the workpiece moves along the workpiece feed path; and a guide device that engages the workpiece and guides the workpiece along the workpiece feed path with a predetermined orientation;

the at least one pair of rotary tools configured and positioned to oppose each other to engage the workpiece while assisting in maintaining a positioning of the workpiece with respect to the feed trajectory while moving along the workpiece feed path, the workpiece including slits, and wherein the guide device comprises partitions oriented parallel to the feed trajectory, the partitions engaging the slits of the workpiece to while allowing the workpiece to translate along the workpiece feed path relative to the partitions.

2. The machine according to claim 1, wherein the partitions are straight.

3. The machine according to claim 1, wherein the slits are radially positioned in the workpiece and the partitions are radially oriented in angular arcs around the feed trajectory.

4. The machine according to claim 1, wherein the at least one pair of rotary tools each has a cylindrical shape, with each of the at least one pair of rotary tools being rotatable about a respective axis of rotation which is normal to the feed trajectory.

5. The machine according to claim 4, wherein the at least one pair of rotary tools lie respectively in planes radial to the feed trajectory.

6. The machine according to claim 1, wherein the engagement of the partitions with the slits allows for altering an angular orientation of the workpiece around the feed trajectory with respect to the partitions during corresponding passes of the workpiece through the working station.

7. The machine according to claim 6, and further comprising a rotating device for rotating the workpiece with respect to the feed trajectory between the corresponding passes through the working station.

8. The machine according to claim 1, wherein the workpiece has an axial symmetry.

9. The machine according to claim 1, wherein the at least one pair of rotary tools are grinding tools.

10. The machine according to claim 1, wherein the at least one pair of rotary tools are grinding wheels.

11. A method for grinding a series of workpieces, comprising:

providing a machine for removing material from a workpiece, comprising:

a working station, including;

at least one pair of rotary tools;

a workpiece feed path defined between the at least one pair of rotary tools, the workpiece feed path having a feed trajectory and passing between the at least one pair of rotary tools from an upper end to a lower end of the workpiece feed path;

the at least one pair of rotary tools being positioned around the feed trajectory for removing material from the workpiece as the workpiece moves along the workpiece feed path; and a guide device that engages the workpiece and guides the workpiece along the workpiece feed path with a predetermined orientation;

the at least one pair of rotary tools configured and positioned to oppose each other to engage the workpiece while assisting in maintaining a positioning of the workpiece with respect to the feed trajectory while moving along the workpiece feed path, the workpiece including slits, and wherein the guide device comprises partitions oriented parallel to the feed trajectory, the partitions engaging the slits of the workpiece to while allowing the workpiece to translate along the workpiece feed path relative to the partitions;

providing that the at least one pair of rotary tools are grinding wheels for grinding the workpieces:

feeding a series of the workpieces along the workpiece feed path;

rotating each of the workpieces that exits the workpiece feed path by a predetermined angular step;

feeding each of the workpieces back into the workpiece feed path for further grinding of the workpiece; and repeating the rotating and feeding steps until the grinding has been completed.

* * * * *